US006405422B1

(12) United States Patent
Hoenigman

(10) Patent No.: US 6,405,422 B1
(45) Date of Patent: Jun. 18, 2002

(54) TROPHY MAKING FIXTURE

(75) Inventor: Aloysius Hoenigman, Newbury, OH (US)

(73) Assignee: Great American Awards, Inc., Newbury, OH (US)

( * ) Notice: Subject to any disclaimer, the term of this patent is extended or adjusted under 35 U.S.C. 154(b) by 0 days.

(21) Appl. No.: 09/649,241

(22) Filed: Aug. 28, 2000

(51) Int. Cl.[7] ..... B25B 27/14
(52) U.S. Cl. ..... 29/281.5
(58) Field of Search ..... 29/281.5, 281.1, 29/240, 283

(56) References Cited

U.S. PATENT DOCUMENTS 2,301,438 A 11/1942 Moeller
4,318,317 A 3/1982 Zerbe
4,989,307 A 2/1991 Sharpe et al.
5,119,544 A 6/1992 Jackson
5,983,475 A * 11/1999 Umling ..... 29/281.5

* cited by examiner

*Primary Examiner*—Robert C. Watson
(74) *Attorney, Agent, or Firm*—D. Peter Hochberg; Katherine R. Vieyra; Sean F. Mellino

(57) ABSTRACT

A trophy making assembly consisting of a base, rear sidewall, and a cantilever flange. The flange has a protruding portion where a collar is attached for receiving a cavity in the base of the trophy. The trophy assembly is rested upon the flange during final assembly. The assembly rod from the trophy is inserted through an aperture in the collar and flange. The nut holding the trophy assembly is threaded onto the rod from underneath the flange and tightened with a fastening means such as socket wrench. A pair of apertures in the base of the fixture allows the fixture to be mounted with screws or bolts to a working surface such as a work bench.

7 Claims, 3 Drawing Sheets

TROPHY MAKING FIXTURE

BACKGROUND OF THE INVENTION

1. Field of the Invention

The present invention relates generally to assembly devices for trophies. More specifically, the present invention relates to a fixture that holds a trophy during assembly so that the nut holding the trophy together can be tightened from underneath the trophy.

2. Description of the Prior Art

The awarding of a trophy is a way to reward those who have won special recognition in a competitive event. Many amateur athletes who excel in some competitive event are awarded trophies. Nearly every high school, college, bowling alley and locker room will have the familiar case with an assortment of trophies displayed therein. Trophies range in style from simple figurines mounted on a base to large sophisticated pieces mounted on columns supported by a base.

The assembly of trophies in the past has generally been done by hand. The various components are aligned, usually by inserting a rod protruding from the mounted piece into a hole passing through the lower components, and then securing the assembly together by adding and tightening a nut onto a threaded portion on the bottom on the rod. This operation has generally been done by the assembler holding the entire assembly while simultaneously tightening the nut. From time to time the pieces slip from their proper position during the assembly process, and the work must be started anew. Consequently, there has been a need felt for a more efficient way to hold trophies during assembly and simplify the process for the assembler.

U.S. Pat. No. 4,318,317 issued to Zerbe describes an apparatus for assembling the components of a trophy. The apparatus includes a socket for engaging a nut employed to connect the components, a bidirectional motor coupled to the socket, a clutch mechanism coupling the bidirectional motor to the socket, a spring retained between the motor and the socket to allow axial movement of the socket relative to the motor, and a bracket for adjustably mounting the motor, clutch mechanism, and spring beneath a work surface for supporting the components of the trophy. The socket is biased upward by the spring so that it projects above the working surface. The motor is operable in a first direction to tighten the nut and in a second direction to loosen the nut. The clutch mechanism provides a torque-limited connection between the motor and the socket in the first direction to prevent excessive tightening of the nut and a positive connection in the second direction to loosen the nut.

The present invention provides a much simplified alternative to that presented in the prior art. The present invention is designed to be mounted on virtually any surface such as a work table. Many of these fixtures according to the invention could be installed on work tables so that many workers can assemble trophies simultaneously. The cantilever flange design allows the assembler to reach beneath the trophy and tighten the nut on the bottom of the trophy because the area beneath the cantilever flange is open. The key advantage of the present invention is that the area beneath the cantilever flange is located above the surface the fixture according to the invention is mounted on. In contrast, the design of the invention in the fixture of U.S. Pat. No. 4,318,317 requires that the nut on the bottom of the trophy be tightened beneath the working surface. One could not reach beneath the surface and manually tighten the nut. In fact, an electric motor operated by a foot pedal is provided for this purpose. This has several disadvantages that the present invention overcomes. The present invention allows the assembler to use any tool to tighten the nut or other fastener that may be used. The prior art device is limited to the sockets that cooperate with the output shaft of the motor. The prior art device is also considerably more complex in design and cost. The present invention provides a solution where many of such devices could be purchased at considerably less cost than even a single device of the '317 patent.

SUMMARY OF THE INVENTION

It is an object of the invention to provide a fixture for assembling trophies.

It is another object of the invention to provide a fixture for assembling trophies by hand.

A further object of the invention to provide a fixture for assembling trophies where a socket wrench or other tightening tool can be used to tighten the trophy in the area just beneath the trophy but above the surface the fixture is mounted on.

It is another object of the invention to provide a cantilever style flange where a trophy may be set during assembly.

Yet an additional object of the invention is to provide a collar of the cantilever style for receiving the bottom of the trophy and holding it there during assembly.

It is still a further object of the invention to provide a base on the fixture for mounting the fixture to a working surface such as a work bench or table.

The foregoing and other objects of the invention are achieved by means of a trophy assembly fixture having a cantilever flange where a trophy may be rested during the assembly process. A collar seated on the flange receives the cavity commonly formed in the lower surface of the trophy base. An aperture in the flange and collar allow the insertion of a tool such as a socket wrench to access the assembly nut. The assembly nut is threaded onto the free end of a rod that protrudes through the lower components of the trophy from the mounting piece to hold the trophy together.

DESCRIPTION OF THE PREFERRED EMBODIMENT

Figure 1:
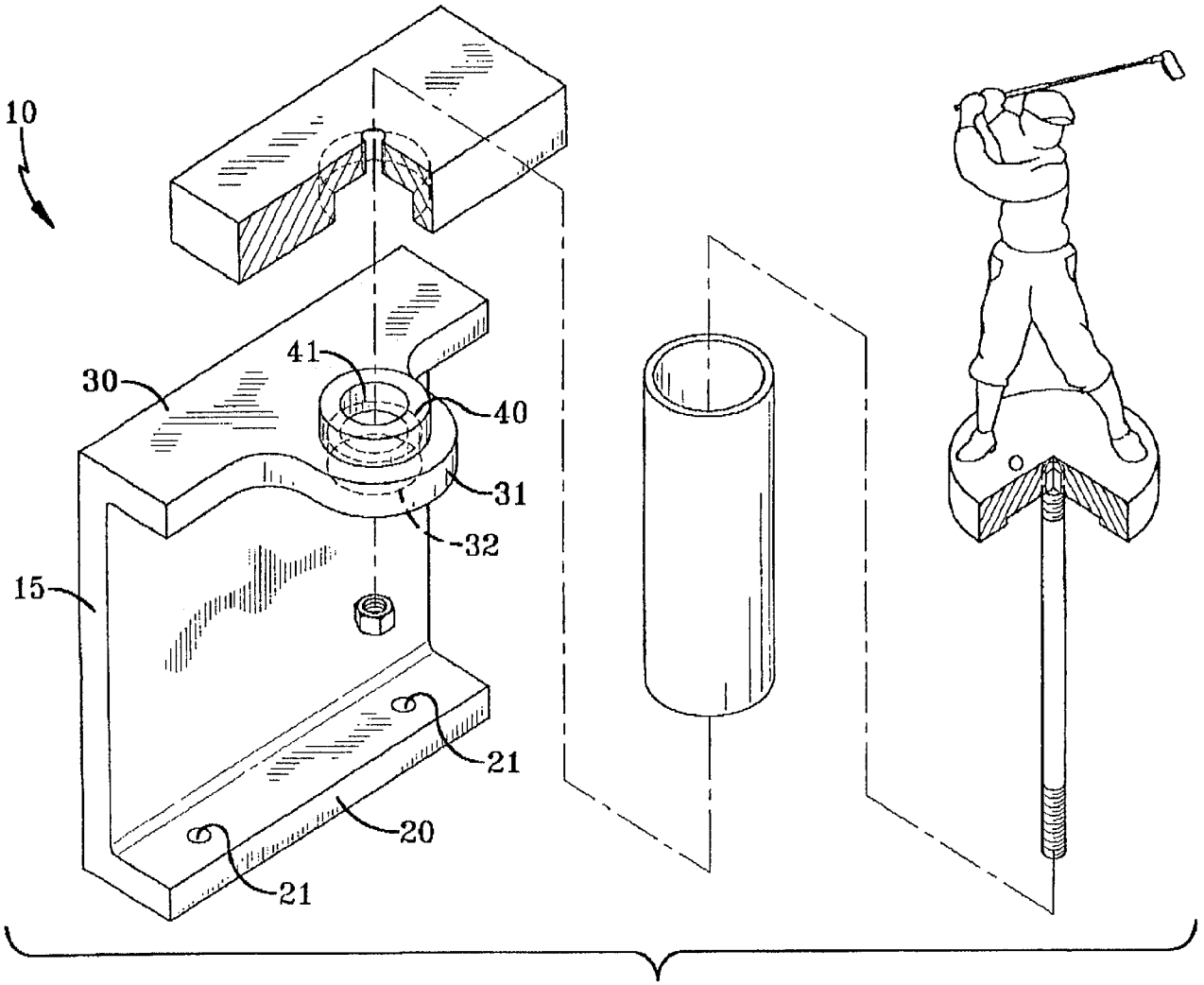
FIG. 1 is an elevated front perspective view of the preferred embodiment of the invention.

Referring first to FIG. 1, a trophy making fixture 10 is shown in the preferred aspect of the invention. The device 10 is used for assembling the components of a trophy of the type typically awarded at sporting events or for acheivements. Such trophies are usually made of a minimum of a base and a mounting piece, but may have other components mounted therebetween. The mounting piece can be a figurine or other symbol. Generally, the mounting piece will have a rod protruding from its lower end. The lower end of this rod will have a threaded portion for receiving a nut. The rod portion is inserted through each and every independent component of the trophy, with the last or bottom-most component being the base portion. The nut will then be threaded onto the end of the rod to hold the trophy assembly together. Trophy assemblers usually assemble the trophy by hand holding the components together, inserting the rod, and then threading on the nut. This can prove to be quite clumsy. The trophy components are sometimes turned during the assembly process. The present invention offers an alternative to this by providing a fixture 10 where the unassembled components of a trophy may be supported until assembly is complete. The device 10 consists of a U-shaped bracket or fixture made out of a high strength material such as metal or hard plastic. If a plastic material is chosen, the plastic must be capable of being formed and molded. In the one aspect of the invention, the material is metal such as steel. The fixture 10 is comprised of a base 20 having a finite thickness connected to a rear sidewall 15. Base 20 and rear sidewall 15 are identical in thickness and width. Rear sidewall 15 extends vertically from base 15 a finite length. Extending perpendicularly from the top edge of rear sidewall 15 is a flange 30. Flange 30 extends from rear sidewall 15 in a cantilever fashion. No exact length of rear sidewall 15 is essential to the functionality of the device but the length must be at least enough to allow one to get beneath flange 30 with a tightening means and maneuver the same therein to tighten the nut on the bottom of the trophy. Both flange 30 and base 20 can be attached to rear sidewall 15 by welding in the case of metal parts, or the entire assembly can be cast or molded as one piece. No exact thickness of base 20, rear sidewall 15 and flange 30 is required except that these components must be thick enough to be sturdy and durable.

Flange 30 has a protruding portion 31 extending from the front edge of flange 30. Protruding portion 31 has an aperture 32 formed in it for allowing a tightening means or tool to pass therethrough to access the nut located in a cavity on the bottom of the trophy. Mounted on the upper surface of flange 30 in the area of protruding portion 31 is a collar 40. Collar 40 is ring shaped having an outer diameter and an inner diameter with a collar aperture 41 located in the center. Collar 40 is positioned concentrically over aperture 32 in flange 30 so that the geometric center of collar aperture 41 of collar 40 lies exactly over the geometric center of aperture 32 in flange 30. Collar 40 cooperates with a cavity that is usually preformed in the lower surface of the base component of the trophy as shown in FIG. 1.

Figure 3:
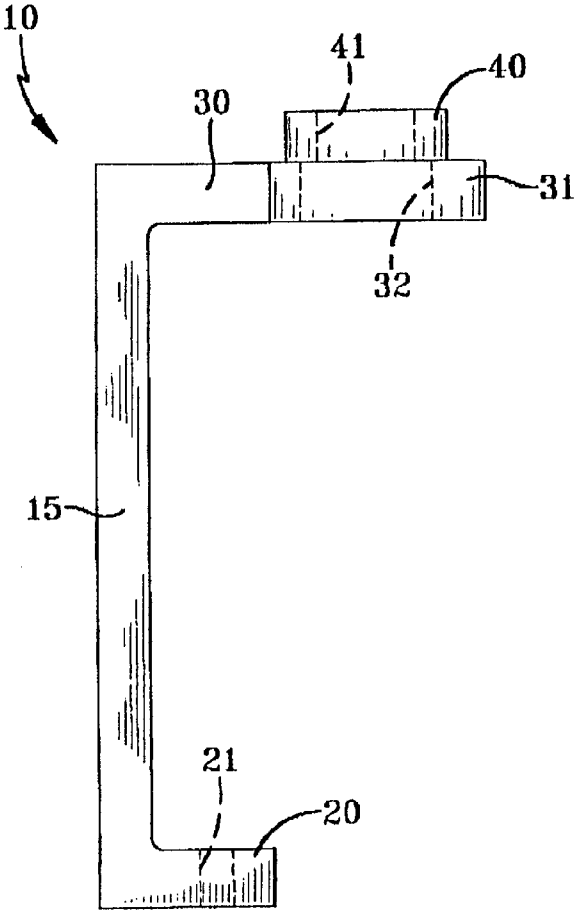
FIG. 3 is a side view thereof.
Figure 2:
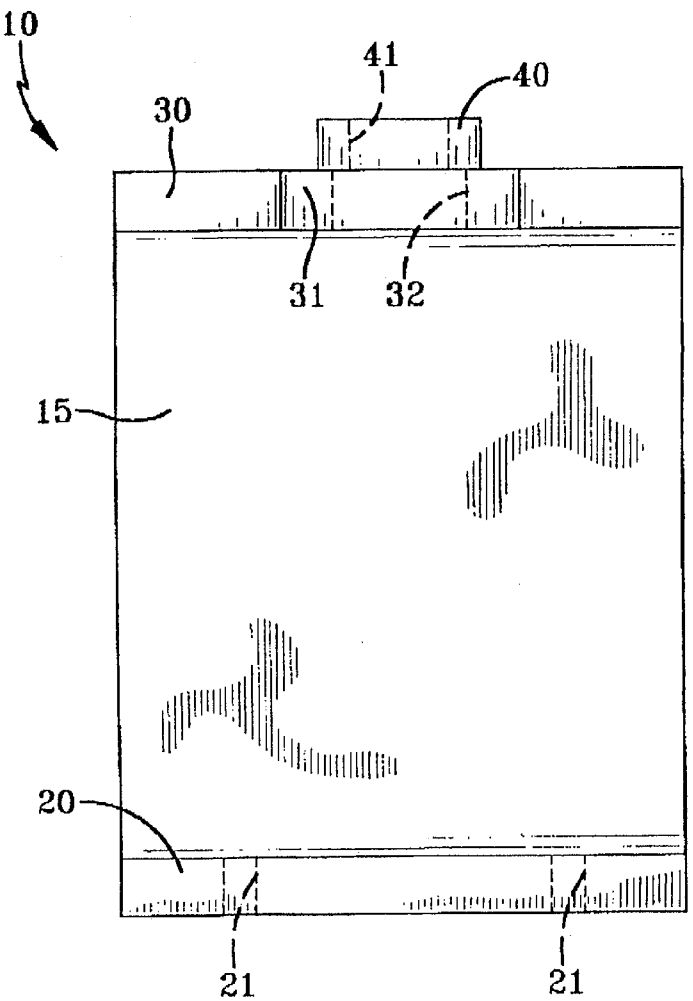
FIG. 2 is a front view thereof.

Referring now to FIGS. 2 and 3, flange 30 extends perpendicularly in a cantilever fashion from the top edge of rear sidewall 15. Collar 40 is mounted on the top surface of flange 30 in the area of the protruding portion 31. Collar 40 may be welded, glued, or integrally formed with fixture 10. Collar aperture 41 in the center of collar 40 may be slightly smaller in diameter than aperture 32 formed in protruding region 31. This is to prevent a tightening means such as a socket wrench inserted into aperture 32 from traveling further than the bottom surface of collar 40. Extending perpendicularly from the bottom edge of rear sidewall 15 is base 20. Base 20 extends from the bottom edge of rear sidewall 20 a distance large enough so that fixture 10 would be supported if set upon a level surface. A pair of attachment apertures 21 are located adjacent to the left and right edge of base 20 so that fasteners such as screws or bolts may be used to attach base 20 and fixture 10 to a horizontal surface such as a work table or bench. Clamps or other attachment means could also be used.

Figure 5:
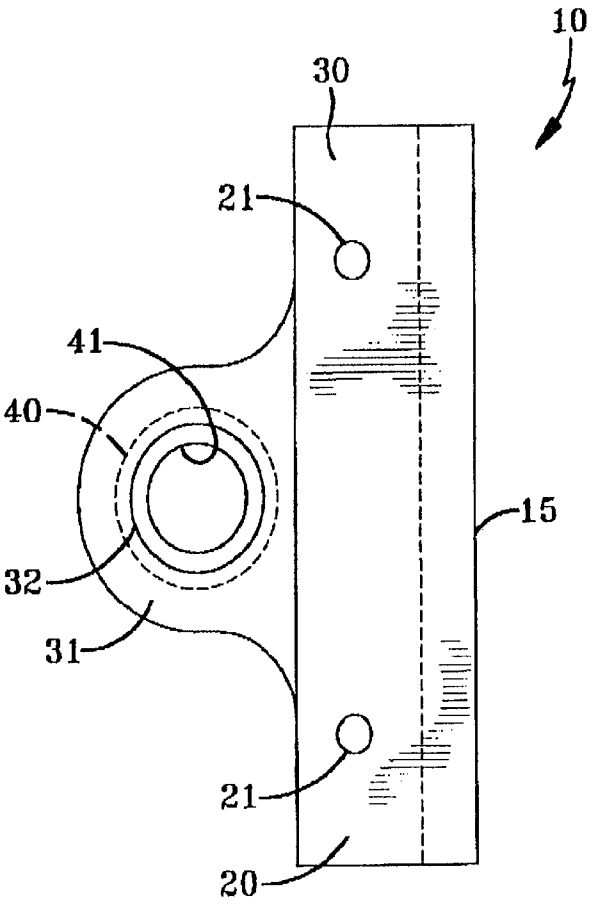
FIG. 5 is a bottom view thereof.
Figure 4:
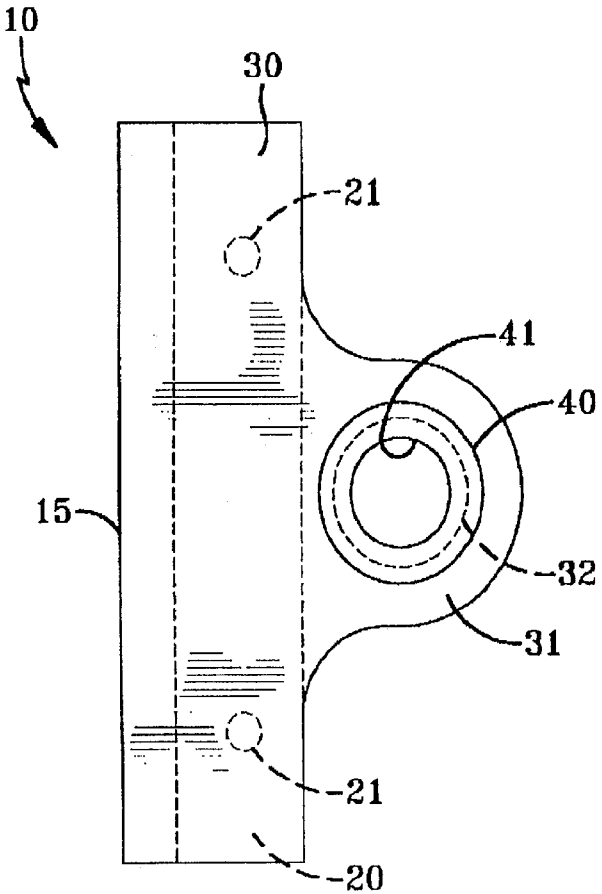
FIG. 4 is a top view thereof.

Referring now to FIGS. 4 and 5, shown are respective top and bottom views of trophy making fixture 10. Collar 40 can be seen mounted in the protruding portion 31 of flange 30. Collar aperture 41 in collar 40 allows a rod passing through the center of the trophy assembly to pass through collar 40 so that a nut can be attached to the rod and tightened underneath flange 30 to hold the trophy together. In FIG. 5, an aperture 41 can be seen where a tightening means such as a socket wrench may be inserted to tighten the nut onto the bottom of the rod from the trophy assembly. A pair of attachment apertures 21 cab be seen located adjacent to the left and right edges of base 20.

To use the above embodiment of the present invention, one simply inserts the rod extending from the mounting piece through the lower components of the trophy, through the base component, and finally through collar aperture 41 and aperture 32. Collar 40 receives a cavity that is generally formed in the base component of the trophy assembly. The remaining trophy components are added and will remain supported on top of the base component resting on top of collar 40 and flange 30. An assembler can now reach beneath flange 30 and start threading a nut onto the bottom end of the rod protruding from the lower surface of the base component. Once hand tight, a tightening means such as a socket wrench can be applied to the nut to urge it to a tightened position. The assembled trophy is then just lifted from collar 40. The fixture 10 is now ready for use to assemble the next trophy. Several fixtures 10 can be set up in an environment where it is desirable to assemble many trophies quickly and efficiently.

Although the foregoing fixture has been described for the manual assembly of trophies it is capable of use with machinery for the expediting the assembly process. Such machinery could include electric or air operated wrenches, power operated trophy holding units and the like.

The invention has been described in detail, with particular emphasis being placed on the preferred embodiments thereof, but variations and modifications may occur to those skilled in the art to which the invention pertains.

What is claimed is:

1. A fixture for assembling trophies, comprising:

a base for attaching said fixture to a horizontal surface;

a rear sidewall transversely attached to said base and extending vertically a finite length;

a flange transversely attached to and extending from a tope edge of said rear sidewall in a cantilever fashion;

a protruding portion extending from a front edge of said flange;

a first aperture formed in said protruding portion; and a ring shaped collar mounted on an upper surface of said protruding portion positioned concentrically over said first aperture for receiving a cavity formed in a base component of the trophy;

wherein said collar holds the base component of the trophy for supporting other trophy components and a mounting piece while an assembler tightens a nut located on a bottom end of a rod that extends from the mounting piece, passes through the other trophy components, and protrudes from beneath a lower surface of the base component, the nut being tightened with a tightening means in the area beneath said flange.

2. The fixture of claim 1, wherein said base extends from a bottom edge of said rear sidewall a distance large enough so that said fixture would be supported on a level surface, and a pair of attachment apertures are formed in said base for receiving fasteners to attach said base to the horizontal surface.

3. The fixture of claim 1, wherein said collar has a collar aperture formed in the center having a diameter slightly smaller than the diameter of said first aperture to prevent the tightening means inserted into said aperture from traveling further than a bottom surface of said collar.

4. The fixture of claim 1, wherein said fixture if formed from a high strength material from the group consisting of metal or plastic.

5. The fixture of claim 1, wherein said length must be at least long enough to allow one to get beneath said flange with the tightening means to tighten the nut.

6. The fixture of claim 1 wherein said rear sidewall is perpendicularly attached to said base.

7. The fixture of claim 1 wherein said flange is perpendicularly attached to said top edge of said rear sidewall.

* * * * *